United States Patent [19]

Barker

[11] Patent Number: 5,024,601

[45] Date of Patent: Jun. 18, 1991

[54] SUPPORT DEVICE FOR SUPPORTING A SKATER

[76] Inventor: Henry E. Barker, 1741 Porter Ave., Beloit, Wis. 53511

[21] Appl. No.: 486,149

[22] Filed: Feb. 28, 1990

Related U.S. Application Data

[63] Continuation-in-part of Ser. No. 368,282, Jun. 19, 1989, abandoned.

[51] Int. Cl.[5] ..... G09B 19/00

[52] U.S. Cl. ..... 434/255; 272/70

[58] Field of Search ..... 272/70, 70.3, 70.4; 434/255, 242; 135/67; 297/5

[56] References Cited

U.S. PATENT DOCUMENTS

| | | | |
|---|---|---|---|
| 1,917,440 | 7/1933 | Finkbeiner et al. | 272/70.4 X |
| 2,278,901 | 4/1942 | Smock | 272/70.4 |
| 2,459,066 | 1/1949 | Duke | 297/5 |
| 2,556,121 | 6/1951 | Thomas | 272/70 X |
| 3,237,940 | 3/1966 | Johnson | 272/70.3 X |
| 3,422,830 | 1/1969 | Cherup | 135/67 |
| 4,312,505 | 1/1982 | Engelhart | 272/70.3 |

FOREIGN PATENT DOCUMENTS

| | | | |
|---|---|---|---|
| 1048148 | 11/1966 | United Kingdom | 272/70.3 |
| 2146540 | 4/1985 | United Kingdom | 272/70.4 |

*Primary Examiner*—Richard J. Apley
*Assistant Examiner*—Rachel M. Healey
*Attorney, Agent, or Firm*—David J. Archer

[57] ABSTRACT

A support device for supporting a skater comprising a first extensible frame of inverted U-shaped configuration, the first frame having a first and a second end. A first handle is rigidly secured to the first frame between the first and second end for supporting the skater. The device also includes a second extensible frame of inverted U-shaped configuration, the second frame being spaced and parallel relative to the first frame. The second frame has a first and a second extremity. A second handle is rigidly secured to the second frame between the first and second extremities for supporting the skater such that in use of the device, the skater is disposed between the handles. First and second laterally extensible supports extend between the first and second frames such that, in use of the device, the skater is disposed between the supports, the arrangement being such that adjustment of a first distance between the supports and a second distance between the frames is permitted so that the device provides adjustable support according to the size and skating ability of the skater. Caster are secured to the ends and the extremities for permitting the skater to develop balance and to practice skating techniques while the skater is supported by the handles.

6 Claims, 2 Drawing Sheets

SUPPORT DEVICE FOR SUPPORTING A SKATER

CROSS REFERENCE TO RELATED APPLICATION

This application is a continuation-in-part of abandoned application Ser. No. 07/368,282 filed June 19, 1989. All the disclosure of Ser. No. 07/368,282 is incorporated herein by reference.

BACKGROUND OF THE INVENTION

1. Field of the Invention

The present invention relates to a support device for a skater. More particularly, the present invention relates to a device which permits a skater to develop balance and to practice skating techniques while supported by the device.

2. Information Disclosure Statement

When amateur skaters contemplate the grace and skill of professional skaters such as John Cousins performing in international competitions, such skaters are enthused to attempt to imitate some of such performers skating techniques.

Unfortunately, even the most simple techniques such as skating in reverse or turning from forward to reverse skating often result in several falls which may unnerve all but the most determined skaters.

The present invention seeks to overcome the fears and dangers associated with learning the aforementioned skating skills. The device according to the present invention also enables the user to rapidly develop balance and confidence such that the beginner skater can quickly master the art of figure skating and the like.

Basically, the present invention provides an adjustable frame with casters thereon for supporting the skater thereby allowing the user to maintain balance while skating either on ice or while roller skating on a roller skating rink.

Therefor, it is a primary objective of the present invention to provide a support device which overcomes the aforementioned fears and dangers associated with learning to skate.

Another object of the present invention is the provision of a support device which enables a more advanced skater to develop sophisticated skating techniques without any fear of losing balance.

Another object of the present invention is the provision of a support device which enables a skater to practice in a very small area for example in the users garage or recreation room.

Other objects and advantages of the present invention will become evident to those skilled in the art by a consideration of the detailed description contained hereinafter taken in conjunction with the annexed drawings.

SUMMARY OF THE INVENTION

The present invention relates to a support device for supporting a skater. The device comprises a first extensible frame of inverted U-shaped configuration, the first frame having a first and a second end. A first handle is rigidly secured to the first frame between the first and second end for supporting the skater. The device also includes a second extensible frame of inverted U-shaped configuration, the second frame being spaced and parallel relative to the first frame. The second frame having a first and a second extremity.

A second handle is rigidly secured to the second frame between the first and second extremities for supporting the skater such that in use of the device, the skater is disposed between the handles. First and second laterally extensible supports extend between the first and second frames such that, in use of the device, the skater is disposed between the supports. The arrangement is such that adjustment of a first distance between the supports and a second distance between the frames is permitted so that the device provides adjustable support according to the size and skating ability of the skater. Casters are secured to the ends and the extremities for permitting the skater to develop balance and to practice skating techniques while the skater is supported by the handles.

In a more specific embodiment of the present invention, the first frame includes a first and a second downwardly extending limb, the first and second limbs including respectively, a first and second selectively lockable extension means for permitting selective adjustment of the height of the first handle relative to the caster means. Additionally, the second frame includes a third and fourth downwardly extending limb, the third and fourth limbs including respectively a third and fourth selectively lockable extension means for permitting selective adjustment of the height of the second handle relative to the caster means. The first and second frame further include first means disposed between the first and second limbs for selectively locking the first distance between the supports and second means disposed between the third and fourth limbs for selectively locking the first distance between the supports.

The first means includes a substantially horizontally disposed member, and an arm slidably cooperating with the member such that adjustment of the first distance is permitted. The second means also includes a substantially horizontally disposed further member and a further arm slidably cooperating with the further member such that adjustment of the first distance is permitted.

The member and the arm define a plurality of axially spaced aligned holes. Additionally, the first means further includes a locking pin removably extending through a pair of the aligned holes for locking the member and the arm relative to each other. The further member and the further arm define a further plurality of axially spaced aligned holes. The second means includes a further locking pin removably extending through a further pair of aligned holes of the further plurality of holes for locking the further member and the further arm relative to each other.

The first handle includes a hand grip disposed substantially horizontally. A portion is rigidly secured to the first frame and extends generally outwards and then downwards relative to the skater such that the portion is disposed between the first frame and the hand grip. The second handle includes a further hand grip disposed substantially horizontally and a further portion is rigidly secured to the second frame and extends generally outwards and then downwardly relative to the skater such that the further portion is disposed between the second frame and the further hand grip. The arrangement is such that in use of the device, when the skater grips the respective handles, the wrists of the skater are braced and supported by the portion and further portion respectively so that the control and balance of the skater is enhanced.

The device also includes an auxiliary handle secured to the first frame and axially spaced relative to the first handle. A further auxiliary handle is secured to the second frame and is axially spaced relative to the second handle. The arrangement is such that in use of the device by a more experienced skater, the skater grips the respective auxiliary handles while the first and second handles support the upper arms of the skater.

The first support includes a horizontally disposed first section rigidly secured to the first frame between the first handle and the first end of the frame. A first further section telescopically cooperates with the first section. A fastening means is included for adjustably fastening the first section and a first further section together such that in use of the device, the second distance between the frames is established. The second support includes a horizontally disposed second section rigidly secured to the first frame and a second further section telescopically cooperating with the second section. A further fastening means is included for fastening the second section and the second further section together for establishing the second distance between the frames.

Many modifications and variations of the present invention will be apparent to those skilled in the art on consideration of the detailed description contained hereinafter taken in conjunction with the annexed drawings. However, such modifications fall within the spirit and scope of the present invention as defined by the appended claims.

Included in such modifications would be securing means for removably securing the auxiliary handles to the respective frames in order to assist in packaging and transportation of the device.

BRIEF DESCRIPTION OF THE DRAWINGS

Similar reference characters refer to similar parts throughout the various figures of the drawings.

DETAILED DESCRIPTION OF THE DRAWINGS

Figure 1:
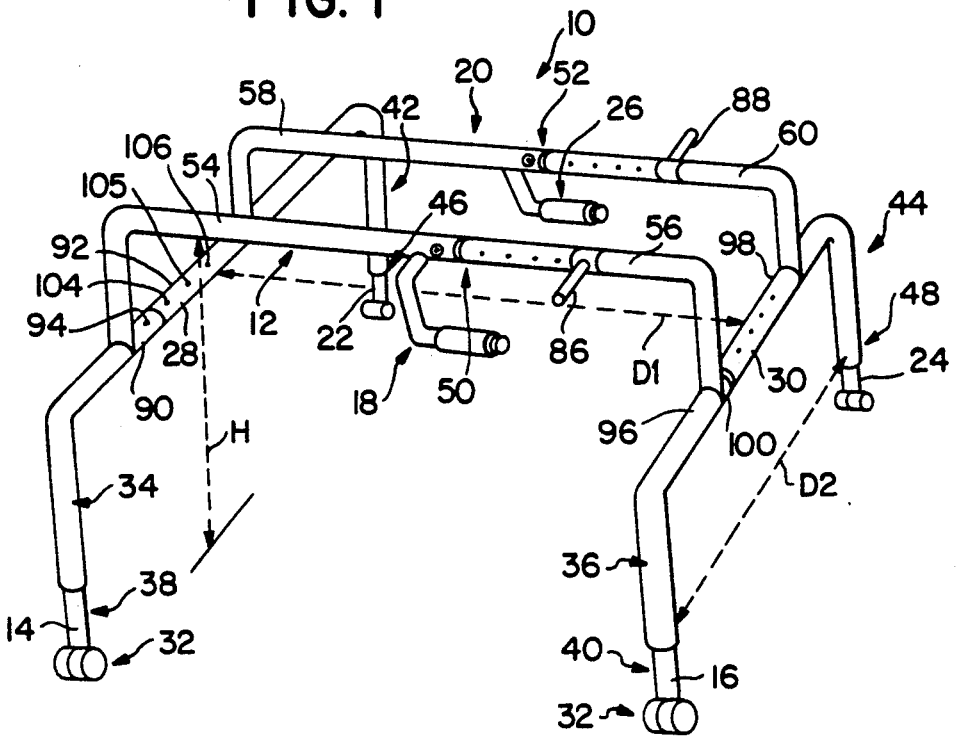
FIG. 1 is a perspective view of the support device according to the present invention.
Figure 2:
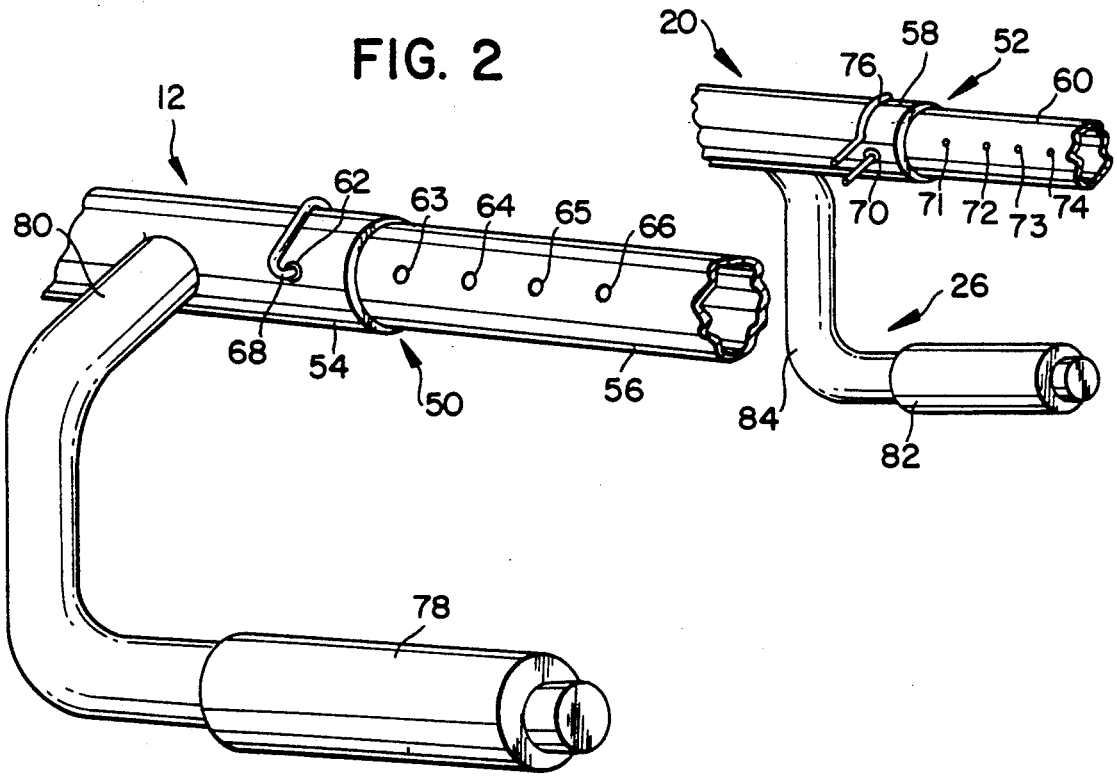
FIG. 2 is an enlarged fragmentary perspective view of the first and second means for selectively locking the first distance.

FIG. 1 is a perspective view of the support device generally designated 10 according to the present invention for supporting a skater. The device 10 comprises a first extensible frame 12 of inverted U-shaped configuration. The first frame 12 has a first and a second end 14 and 16 respectively. A first handle 18 is rigidly secured to the first frame 12 between the first and second end 14 and 16 respectively for supporting the skater. The device 10 also includes a second extensible frame 20 of inverted U-shaped configuration, the second frame 20 being spaced and parallel relative to the first frame 12, the second frame 20 having a first and a second extremity 22 and 24 respectively. A second handle 26 is rigidly secured to the second frame 20 between the first and second extremities 22 and 24 for supporting the skater such that in use of the device 10, the skater is disposed between the handles 18 and 26 respectively. A first and second laterally extensible support 28 and 30 respectively extend between the first and second frames 12 and 20 respectively such that, in use of the device 10, the skater is disposed between the supports 28 and 30. The arrangement is such that adjustment of a first distance D1 between the supports 28 and 30 respectively and a second distance between the frames 12 and 20 respectively is permitted so that the device 10 provides adjustable support according to the size and skating ability of the skater. The device 10 also includes caster means 32 secured to the ends 14 and 16 and the extremities 22 and 24 for permitting the skater to develop balance and to practice skating techniques while the skater is supported by the handles 18 and 26 respectively.

In a more specific embodiment of the present invention, the first frame 12 includes a first and a second downwardly extending limb 34 and 36 respectively. The first and second limbs 34 and 36 include respectively, a first and second selectively lockable extension means 38 and 40 for permitting selective adjustment of the height H of the first handle 18 relative to the caster means 32. The second frame 20 includes a third and fourth downwardly extending limb 42 and 44 respectively. The third and fourth limbs 42 and 44 include respectively a third and fourth selectively lockable extension means 46 and 48 for selective adjustment of the height H of the second handle 26 relative to the caster means 32. The first and second frame 12 and 20 further include first means 50 disposed between the first and second limbs 34 and 36 for selectively locking the first distance D1 between the supports 28 and 30 and second means 52 disposed between the third and fourth limbs 42 and 44 for selectively locking the first distance D1 between the supports.

The first means 50 includes a substantially horizontally disposed member 54. An arm 56 slidably cooperates with the member 54 such that adjustment of the first distance D1 is permitted. The second means 52 also includes a substantially horizontally disposed further member 58 and a further arm 60 slidably cooperating with the further member 58 such that adjustment of the first distance D1 is permitted.

The member 54 and the arm 56 define a plurality of axially spaced aligned holes 62, 63, 64, 65 and 66. The first means 50 further includes a locking pin 68 removably extending through a pair of the aligned holes 62-66 for locking the member 54 and the arm 56 relative to each other. The further member 58 and the further arm 60 define a further plurality of axially spaced aligned holes 70, 71, 72, 73 and 74. The second means 52 includes a further locking pin 76 removably extending through a further pair of aligned holes of the further plurality of holes 70 to 74 for locking the further member 58 and the further arm 60 relative to each other.

The first handle 18 includes a hand grip 78 disposed substantially horizontally. A portion 80 is rigidly secured to the first frame 12 and extends generally outwards and then downwardly relative to the skater such that the portion 80 is disposed between the first frame 12 and the hand grip 78. The second handle 26 includes a further hand grip 82 disposed substantially horizontally and a further portion 84 is rigidly secured to the second frame 20 and extends generally outwards and then downwardly relative to the skater such that the further portion 84 is disposed between the second frame 20 and the further hand grip 82. The arrangement is such that in use of the device 10, when the skater grips the respective handles 18 and 26, the wrists of the skater are braced and supported by the portion 80 and further portion 84 respectively so that the control and balance of the skater is enhanced.

The device 10 also includes an auxiliary handle 86 secured to the first frame 12 and axially spaced relative to the first handle 18. A further auxiliary handle 88 is secured to the second frame 20 and axially spaced relative to the second handle 26. The arrangement is such that in use of the device 10 by a more experienced skater, the skater grips the respective auxiliary handles 86 and 88 while the first and second handles 18 and 26 support the upper arms of the skater.

The first support 28 includes a horizontally disposed first section 90 rigidly secured to the first frame 12 between the first handle 18 and the first end 14 of the first frame 12. A first further section 92 telescopically cooperates with the first section 90. A fastening means 94 is included for adjustably fastening the first section 90 and first further section 92 together such that in use of the device 10, the second distance D2 between the frames 12 and 20 is established. The second support 30 includes a horizontally disposed second section 96 rigidly secured to the first frame 12 and a second further section 98 telescopically cooperating with the second section 96. A further fastening means 100 is included for fastening the second section 96 and the second further section 98 together for establishing the second distance D2 between the frames 12 and 20.

Figure 3:
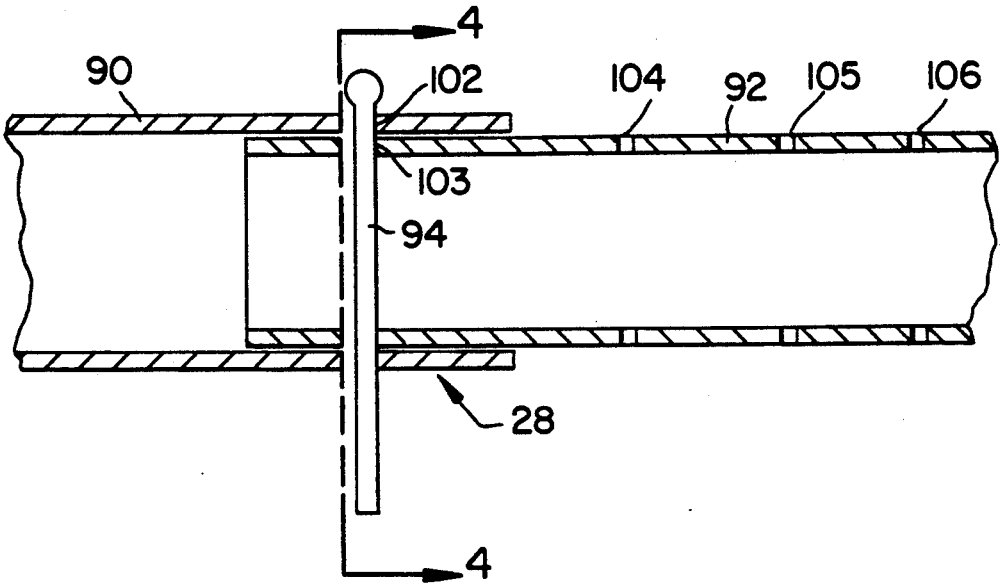
FIG. 3 is a sectional view of one of the supports.

FIG. 3 is an enlarged sectional view of one of the supports generally designated 28. The support 28 includes the first section 90 and the first further section 92 slidably disposed within the first section 90. The fastening means 94 extends through aligned orifices 102, 103. The first further section 92 includes a number of such orifices 104, 105 and 106 to permit adjustment of the second distance D2.

Figure 4:
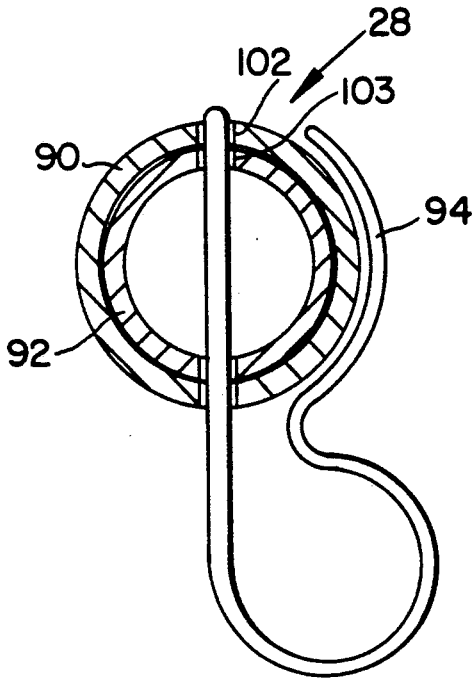
FIG. 4 is a sectional view taken on the line 4—4 of FIG. 3.

FIG. 4 is a sectional view taken on the line 4—4 of FIG. 3 and shows the fastening means 94 as a spring clip for locking the sections 90 and 92 together.

In operation of the support device according to the present invention, the skater steps into the device 10 and holds onto the hand grips 78 and 82. The user's wrists are supported by the portions 80 and 84 so that the weight of the users body is mainly supported by the casters 32. Accordingly, the skater is able to balance while skating forwards or backwards. The skater is also permitted to execute skating techniques which in the absence of the support device according to the present invention would be potentially dangerous.

The support device according to the present invention is a simple device for helping not only a beginner to master the basic techniques of roller or ice skating, but also enables an experienced skater to practice and improve advanced skills within a limited skating facility.

What is claimed is:

1. A support device for supporting a skater, said device comprising:

a first extensible frame of inverted U-shaped configuration, said first frame having a first and a second end;

a first handle rigidly secured to said first frame between said first and second end for supporting the skater;

a second extensible frame of inverted U-shaped configuration, said second frame being spaced and parallel relative to said first frame, said second frame having a first and a second extremity;

a second handle rigidly secured to said second frame between said first and second extremities for supporting the skater such that in use of the device, the skater is disposed between the handles;

first and second laterally extensible supports extending between said first and second frames such that, in use of the device, the skater is disposed between said supports, the arrangement being such that adjustment of a first distance between said supports and a second distance between said frames is permitted so that the device provides adjustable support according to the size and skating ability of the skater;

caster means secured to said ends and said extremities for permitting the skater to develop balance and to practice skating techniques while the skater is supported by said handles;

said first handle including:

a hand grip disposed substantially horizontally;

a portion rigidly secured to said first frame and extending generally outwardly and then downwards relative to the skater such that said portion is disposed between said first frame and said hand grip;

said second handle including:

a further hand grip disposed substantially horizontally;

a further portion rigidly secured to said second frame and extending generally outwardly and then downwards relative to the skater such that said further portion is disposed between said second frame and said further hand grip, the arrangement being such that in use of the device, when the skater grips the respective handles, the wrists of the skater are braced and supported by said portion and further portion respectively so that the control and balance of the skater is enhanced;

said support device further including:

an auxiliary handle secured to said first frame and axially spaced relative to said first handle; and a further auxiliary handle secured to said second frame and axially spaced relative to said second handle, the arrangement being such that in use of the device by a more experienced skater, the skater grips the respective auxiliary handles while said first and second handles support the upper arms of the skater.

2. A support device as set forth in claim 1 wherein said first frame includes:

a first and a second downwardly extending limb;

said first and second limbs including respectively:

a first and second selectively lockable extension means for permitting selective adjustment of the height of said first handle relative to said caster means;

said second frame including:

a third and fourth downwardly extending limb;

said third and fourth limbs including respectively:

a third and fourth selectively lockable extension means for permitting selective adjustment of the height of said second handle relative to said caster means.

3. A support device as set forth in claim 2 wherein said first and second frame further include:

first means disposed between said first and second limbs for selectively locking said first distance between said supports;

second means disposed between said third and fourth limbs for selectively locking said first distance between said supports.

4. A support device as set forth in claim 3 wherein said first means includes:

a substantially horizontally disposed member;

an arm slidably cooperating with said member such that said adjustment of said first distance is permitted;

said second means including:

a substantially horizontally disposed further member;

a further arm slidably cooperating with said further member such that said adjustment of said first distance is permitted.

5. A support device as set forth in claim 4 wherein said member and said arm define a plurality of axially spaced aligned holes;

said first means further including:

a locking pin removably extending through a pair of said aligned holes for locking said member and said arm relative to each other;

said further member and said further arm defining a further plurality of axially spaced aligned holes;

said second means including;

a further locking pin removably extending through a further pair of aligned holes of said further plurality of holes for locking said further member and said further arm relative to each other.

6. A support device as set forth in claim 1 wherein said first support includes:

a horizontally disposed first section rigidly secured to said first frame between said first handle and said first end of said frame;

a first further section telescopically cooperating with said first section;

fastening means for adjustably fastening said first section and first further section together such that in use of the device, said second distance between said frames is established;

said second support including:

a horizontally disposed second section rigidly secured to said first frame;

a second further section telescopically cooperating with said second section;

further fastening means for fastening said second section and said second further section together for establishing said second distance between said frames.

* * * * *